US010235943B2

(12) United States Patent
Han et al.

(10) Patent No.: US 10,235,943 B2
(45) Date of Patent: Mar. 19, 2019

(54) DISPLAY PANEL, METHOD FOR CONTROLLING DISPLAY PANEL AND DISPLAY DEVICE

(71) Applicant: BOE TECHNOLOGY GROUP CO., LTD., Beijing (CN)

(72) Inventors: Dongxu Han, Beijing (CN); Guangcai Yuan, Beijing (CN); Yongqian Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 199 days.

(21) Appl. No.: 15/220,002

(22) Filed: Jul. 26, 2016

(65) Prior Publication Data

US 2017/0110060 A1 Apr. 20, 2017

(30) Foreign Application Priority Data

Oct. 14, 2015 (CN) ..... 2015 1 0661284

(51) Int. Cl.
*G09G 3/3291* (2016.01)
*G09G 3/3258* (2016.01)
(Continued)

(52) U.S. Cl.
CPC ..... *G09G 3/3291* (2013.01); *G09G 3/3225* (2013.01); *G09G 3/3258* (2013.01);
(Continued)

(58) Field of Classification Search
CPC .. G09G 3/3291; G09G 3/3266; G09G 3/3258; G09G 2300/0408; G09G 2300/0842
See application file for complete search history.

(56) References Cited

U.S. PATENT DOCUMENTS 5,408,252 A * 4/1995 Oki ..... G09G 3/3648 345/205
7,382,342 B2 6/2008 Uchino et al.
(Continued)

FOREIGN PATENT DOCUMENTS

CN 1428752 A 7/2003
CN 1536550 A 10/2004
(Continued)

OTHER PUBLICATIONS

Second Chinese Office Action regarding Application No. 201510661284.3 dated Nov. 23, 2017. English translation provided by http://globaldossier.uspto.gov.
(Continued)

*Primary Examiner* — Andrew Sasinowski
(74) *Attorney, Agent, or Firm* — Harness, Dickey & Pierce, P.L.C.

(57) ABSTRACT

The present disclosure provides a display panel, its controlling method and a display device. The display panel includes a plurality of pixel units, a plurality of gate scanning lines arranged on a display substrate and a plurality of data lines arranged on the display substrate and crossing the gate scanning lines. Each pixel unit includes a data writing module, a driving module and a light-emitting element. The data writing module is configured to apply a data voltage to the driving module under the control of a current-level gate scanning signal, and the driving module is configured to drive the light-emitting element to emit light in accordance with the data voltage. The data writing modules of N adjacent pixel units in an identical row are connected to an identical data line, and N is an integer greater than 1. The data voltage across the data line is applied to the data writing modules of the N adjacent pixel units in a time-division
(Continued)

manner under the control of the current-level gate scanning signal.

20 Claims, 2 Drawing Sheets

(51) Int. Cl.
*G09G 3/3266* (2016.01)
*G09G 3/3225* (2016.01)

(52) U.S. Cl.
CPC ... *G09G 3/3266* (2013.01); *G09G 2300/0408* (2013.01); *G09G 2300/0842* (2013.01); *G09G 2310/08* (2013.01)

(56) References Cited

U.S. PATENT DOCUMENTS

| | | | |
|---|---|---|---|
| 8,159,479 | B2 | 4/2012 | Uchino et al. |
| 8,836,678 | B2 | 9/2014 | Uchino et al. |
| 9,076,384 | B2 | 7/2015 | Uchino et al. |
| 9,147,358 | B2 | 9/2015 | Uchino et al. |
| 9,570,007 | B2 | 2/2017 | Uchino et al. |
| 2003/0142509 | A1 | 7/2003 | Tsuchiya et al. |
| 2005/0012736 | A1 | 1/2005 | Uchino et al. |
| 2007/0279403 | A1 | 12/2007 | Uchino et al. |
| 2012/0162164 | A1 | 6/2012 | Uchino et al. |
| 2013/0208021 | A1* | 8/2013 | Lee ..... G09G 3/32 345/690 |
| 2013/0215091 | A1 | 8/2013 | Ma |
| 2014/0152640 | A1 | 6/2014 | Chen et al. |
| 2014/0333212 | A1 | 11/2014 | Uchino et al. |
| 2015/0103061 | A1 | 4/2015 | Uchino et al. |
| 2015/0302800 | A1 | 10/2015 | Uchino et al. |
| 2016/0035302 | A1 | 2/2016 | Sun et al. |
| 2017/0110053 | A1 | 4/2017 | Uchino et al. |

FOREIGN PATENT DOCUMENTS

| | | | |
|---|---|---|---|
| CN | 1573886 | A | 2/2005 |
| CN | 101216649 | A | 7/2008 |
| CN | 100414596 | C | 8/2008 |
| CN | 101562003 | A | 10/2009 |
| CN | 101762915 | B | 4/2013 |
| CN | 103123430 | A | 5/2013 |
| CN | 104200786 | A | 12/2014 |
| JP | S62-218987 | A | 9/1987 |
| JP | 2006018090 | A | 1/2006 |

OTHER PUBLICATIONS

First Office Action regarding Chinese Application No. 201510661284.3, dated May 15, 2017. Translation provided by Dragon Intellectual Property Law Firm.

* cited by examiner

DISPLAY PANEL, METHOD FOR CONTROLLING DISPLAY PANEL AND DISPLAY DEVICE

CROSS-REFERENCE TO RELATED APPLICATION

The present application claims a priority of the Chinese patent application No. 201510661284.3 filed on Oct. 14, 2015, which is incorporated herein by reference in its entirety.

TECHNICAL FIELD

The present disclosure relates to the field of display technology, in particular to a display panel, its controlling method and a display device.

BACKGROUND

For a display panel in related art, usually the number of gate scanning lines and data lines are closely related to its resolution, and an increase in the resolution will lead to an increase in the number of the gate scanning lines and data lines. In this regard, the panel design and the resultant peripheral drivers will be more complex, and thereby the difficulty of the manufacture process will increase. In the related art, the number of the data lines may be reduced by, e.g., increasing the number of the gate scanning lines, or adding Gate On Array (GOA) units or any other gating units for the gate scanning lines. However, at this time, the complexity of the gate scanning design may increase and the yield of the product may be reduced.

SUMMARY

A main object of the present disclosure is to provide a display panel, its controlling method and a display device, so as to simplify the gate scanning design and improve the yield as compared with the related art where the number of the data lines is reduced by increasing the number of the gate scanning lines or adding the GOA units or any other grating units for the gate scanning lines.

In one aspect, the present disclosure provides in some embodiments a display panel, including a plurality of pixel units, a plurality of gate scanning lines arranged on a display substrate and a plurality of data lines arranged on the display substrate and crossing the gate scanning lines. Each pixel unit includes a data writing module, a driving module and a light-emitting element. The data writing module is configured to apply a data voltage to the driving module under the control of a current-level gate scanning signal, and the driving module is configured to drive the light-emitting element to emit light in accordance with the data voltage. The data writing modules of N adjacent pixel units in an identical row are connected to an identical data line, and N is an integer greater than 1. The data voltage across the data line is applied to the data writing modules of the N adjacent pixel units in a time-division manner under the control of the current-level gate scanning signal.

Alternatively, N is 2, and the N adjacent pixel units in an identical row include a first pixel unit and a second pixel unit. A first data writing module of the first pixel unit includes a first data writing transistor, a gate electrode of which is configured to receive the current-level gate scanning signal, a first electrode of which is connected to the identical data line, and a second electrode of which is connected to a first driving module of the first pixel unit. A second data writing module of the second pixel unit includes a second data writing transistor, a gate electrode of which is configured to receive the current-level gate scanning signal, a first electrode of which is connected to the identical data line, and a second electrode of which is connected to a second driving module of the second pixel unit. The first pixel unit and the second pixel unit are located in an identical row. At a data writing stage within each display period, the first data writing transistor and the second data writing transistor are turned on in a time-division manner under the control of the current-level gate scanning signal.

Alternatively, the first data writing transistor is an N-type transistor, and the second data writing transistor is a P-type transistor.

Alternatively, the first data writing transistor is a P-type transistor, and the second data writing transistor is an N-type transistor.

Alternatively, a data writing module of a pixel unit in an $m^{th}$ row and a $(2n+1)^{th}$ column and a data writing module of a pixel unit in an $m^{th}$ row and a $(2n+2)^{th}$ column are connected to an $n^{th}$ data line and configured to receive a data voltage across the $n^{th}$ data line in the time-division manner, m is a positive integer within a range from 1 to A, n is a positive integer within a range from 1 to B, A and B are both positive integers, A is equal to the number of the plurality of gate scanning lines, and 2B+2 is equal to the number of the plurality of data lines.

Alternatively, the light-emitting element includes an organic light-emitting diode (OLED).

Alternatively, each pixel unit further includes a storage capacitor, the driving module of the pixel unit includes a driving transistor, and the storage capacitor is connected between a gate electrode and a first electrode of the driving transistor.

In another aspect, the present disclosure provides in some embodiments a method for controlling the above-mentioned display panel, including a step of: applying the data voltage across the data line to the data writing modules of the N adjacent pixel units in the identical row and connected to the data line in the time-division manner under the control of the current-level gate scanning signal, wherein N is an integer greater than 1.

In yet another aspect, the present disclosure provides in some embodiments a method for controlling the above-mentioned display panel, including a step of: at the data writing stage within each display period, turning on the first data writing transistor and the second data writing transistor in the time-division manner, so as to apply the data voltage across the data line to the first pixel unit and the second pixel unit in the time-division manner.

In still yet another aspect, the present disclosure provides in some embodiments a display device including the above-mentioned display panel.

According to the display panel, its controlling method and the display device in the embodiments of the present disclosure, the data voltage across the identical data line is applied, in a time-division manner, to the data writing modules of at least two adjacent pixel units in an identical row under the control of the current-level gate scanning signal, so as to reduce the number of the data lines without increasing the number of the gate scanning lines, reduce the complexity of the layout of the data lines, and reduce the number of Integrated Circuit (IC) drivers or the number of output ends. As a result, it is able to reduce the production cost and improve the yield.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF THE EMBODIMENTS

Figure 1:
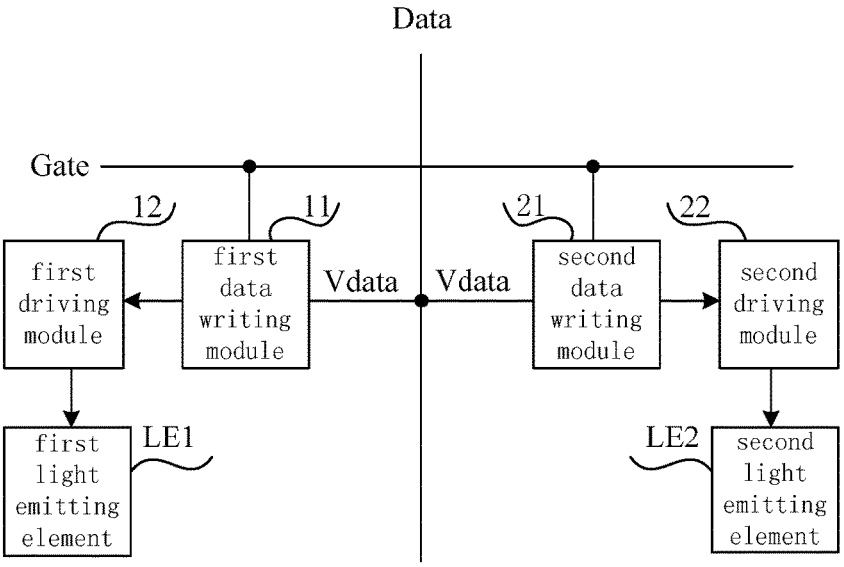
FIG. 1 is a schematic view showing a display panel according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

The present disclosure provides in some embodiments a display panel, which includes a plurality of pixel units, a plurality of gate scanning lines arranged on a display substrate and a plurality of data lines arranged on the display substrate and crossing the gate scanning lines. Each pixel unit includes a data writing module, a driving module and a light-emitting element. The data writing module is configured to apply a data voltage to the driving module under the control of a current-level gate scanning signal, and the driving module is configured to drive the light-emitting element to emit light in accordance with the data voltage. The data writing modules of N adjacent pixel units in an identical row are connected to an identical data line, and N is an integer greater than 1. The data voltage across the data line is applied to the data writing modules of the N adjacent pixel units in a time-division manner under the control of the current-level gate scanning signal.

According to the display panel, its control method and the display device in the embodiments of the present disclosure, the data voltage across the data line is applied, in a time-division manner, to the data writing modules of at least two adjacent pixel units in an identical row under the control of the current-level gate scanning signal, so as to reduce the number of the data lines without increasing the number of the gate scanning lines, reduce the complexity of the layout of the data lines, and reduce the number of IC drivers or the number of output ends. As a result, it is able to reduce the production cost and improve the yield.

Alternatively, N may be 2. At this time, as shown in FIG. 1, a first pixel unit 1 includes a first data writing module 11, a driving module 12 and a first light-emitting element LE1. The first data writing module 11 is connected to a current-level gate scanning line Gate and configured to apply a data voltage Vdata to the first driving module 12 under the control of a current-level gate scanning signal from the current-level gate scanning line Gate. The first driving module 12 is configured to drive the first light-emitting element LE1 to emit light in accordance with the data voltage Vdata. The second pixel unit 2 includes a second data writing module 21, a second driving module 22 and a second light-emitting element LE2. The second data writing module 21 is connected to the current-level gate scanning line Gate and configured to apply the data voltage Vdata to the second driving module 22 under the control of the current-level gate scanning signal from the current-level gate scanning line Gate. The second driving module 22 is configured to drive the second light-emitting element LE2 to emit light in accordance with the data voltage Vdata. The first pixel unit 1 and the second pixel unit 2 are located in an identical row. The data line Data for applying the data voltage Vdata is connected to the first data writing module 11 and the second data writing module 21. The data voltage Vdata across the data line Data is applied in a time-division manner to the first data writing module 11 and the second data writing module 21 under the control of the current-level gate scanning signal from the current-level gate scanning line Gate, so as to reduce the number of the data lines without increasing the number of the gate scanning lines.

During the implementation, the data writing modules of more than two pixel units in an identical row may be connected to an identical data line, and the data voltage from the data line may be applied in a time-division manner to the data writing modules of these pixel units under the control of the current-level gate scanning signal.

To be specific, in the case that the data writing modules of the four pixel units in an identical row are connected to an identical data line, these four pixel units include a first pixel unit, a second pixel unit, a third pixel unit and a fourth pixel unit. The first pixel unit includes a first data writing module which includes a first data writing transistor. The second pixel unit includes a second data writing module which includes a second data writing transistor. The third pixel unit includes a third data writing module which includes a third data writing transistor. The fourth pixel unit includes a fourth data writing module which includes a fourth data writing transistor.

During the implementation, the first data writing transistor and the second data writing transistor may be P-type transistors having different threshold voltages, and the third data writing transistor and the fourth data writing transistor may be N-type transistors having different threshold voltages. In this way, it is able to turn on, in a time-division manner, the first, second, third and fourth data writing transistors at the data writing stage within each display period under the control of the positive and negative current-level gate scanning signals having different voltage values from the current-level gate scanning line.

Alternatively, N may be 2. At this time, a first data writing module of a first pixel unit includes a first data writing transistor, a gate electrode of which is configured to receive the current-level gate scanning signal, a first electrode of which is connected to one of the data lines, and a second electrode of which is connected to a first driving module of the first pixel unit. A second data writing module of the second pixel unit includes a second data writing transistor, a gate electrode of which is configured to receive the current-level gate scanning signal, a first electrode of which is connected to the one of the data lines, and a second electrode of which is connected to a second driving module of the second pixel unit. The first pixel unit and the second pixel unit are located in an identical row. At a data writing stage within each display period, the first data writing transistor and the second data writing transistor are turned on in a time-division manner under the control of the current-level gate scanning signal.

To be specific, the first data writing transistor may be an N-type transistor, and the second data writing transistor may be a P-type transistor. Alternatively, the first data writing transistor may be a P-type transistor, and the second data writing transistor may be an N-type transistor.

In the case that N is 2, the first data writing transistor and the second data writing transistor may be of different types, so as to reduce the number of the data lines without increasing the number of the gate scanning lines.

In the embodiments of the present disclosure, all the transistors may be thin film transistors (TFTs), field effect transistors (FETs) or any other elements having an identical characteristic. Apart from the gate electrode, the other two electrodes of each transistor may be referred to as a first electrode and a second electrode, which may be replaced with each other depending on a current direction. In other words, the first electrode may be a source electrode and the second electrode may be a drain electrode, and vice versa. In addition, depending on its characteristics, the transistor adopted herein may be an N-type or a P-type transistor.

Alternatively, a data writing module of a pixel unit in an $m^{th}$ row and a $(2n+1)^{th}$ column and a data writing module of a pixel unit in the $m^{th}$ row and a $(2n+2)^{th}$ column are connected to an $n^{th}$ data line and configured to receive a data voltage across the $n^{th}$ data line in a time-division manner, m is a positive integer within a range from 1 to A, n is a positive integer within a range from 1 to B, A and B are both positive integers, A is equal to the number of the plurality of gate scanning lines, and 2B+2 is equal to the number of the plurality of data lines.

In the alternative embodiment, the data writing modules of the two adjacent pixel units in each row may be connected to an identical data line, so as to reduce the number of the data lines in the display panel. To be specific, as compared with the related art where 2C data lines are adopted, the display panel in the embodiment of the present disclosure may merely include C data lines, where C is a positive integer.

Alternatively, the light-emitting element may include an OLED, and at this time, the display panel is an OLED display panel.

The display panel will be described hereinafter in more details.

Figure 2:
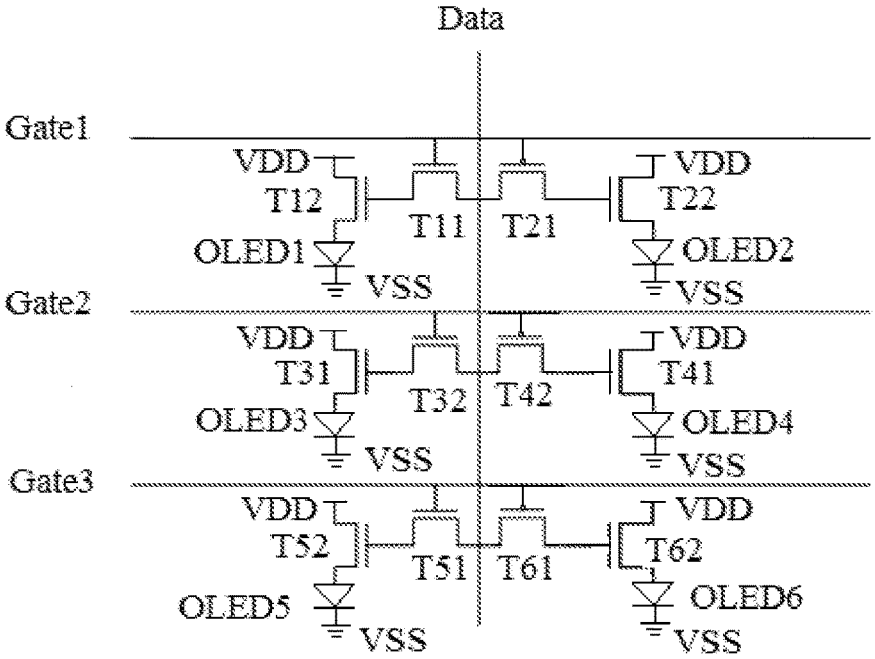
FIG. 2 is another schematic view showing the display panel according to one embodiment of the present disclosure.

As shown in FIG. 2, the display panel includes a first gate scanning line Gate1, a second gate scanning line Gate2, a third gate scanning line Gate3 and a data line Data.

In addition, the display panel further includes a pixel unit in a first row and a first column, a pixel unit in the first row and a second column, a pixel unit in a second row and the first column, a pixel unit in the second row and the second column, a pixel unit in a third row and the first column, and a pixel unit in the third row and the second column.

The pixel unit in the first row and the first column includes a first data writing module, a first driving module and a first organic light-emitting diode OLED1. The first data writing module includes a first data writing transistor T11, a gate electrode of which is connected to the first gate scanning line Gate1, a first electrode of which is connected to the data line Data and a second electrode of which is connected to the first driving module. The first data writing transistor T11 is configured to apply a data voltage across of the data line Data to the first driving module under the control of a first gate scanning signal from the first gate scanning line Gate1. The first driving module includes a first driving transistor T12, a gate electrode of which is connected to the second electrode of the first data writing transistor T11, a first electrode of which is configured to receive a high voltage VDD, and a second electrode of which is connected to an anode of the first organic light-emitting diode OLED1. The first driving transistor T12 is configured to drive the first organic light-emitting diode OLED1 to emit light in accordance with the data voltage across the data line Data. A cathode of the first organic light-emitting diode OLED1 is configured to receive a low voltage VSS. The first data writing transistor T11 is an N-type TFT, and the first driving transistor T12 is an N-type TFT.

The pixel unit in the first row and the second column includes a second data writing module, a second driving module and a second organic light-emitting diode OLED2. The second data writing module includes a second data writing transistor T21, a gate electrode of which is connected to the first gate scanning line Gate1, a first electrode of which is connected to the data line Data, and a second electrode of which is connected to the second driving module. The second data writing transistor T21 is configured to apply the data voltage from the data line Data to the second driving module under the control of the first gate scanning signal from the first gate scanning line Gate1. The second driving module includes a second driving transistor T22, a gate electrode of which is connected to the second electrode of the second data writing transistor T21, a first electrode of which is configured to receive the high voltage VDD, and a second electrode of which is connected to an anode of the second organic light-emitting diode OLED2. The second driving transistor T22 is configured to drive the second organic light-emitting diode OLED2 to emit light in accordance with the data voltage from the data line Data. A cathode of the second organic light-emitting diode OLED2 is configured to receive the low voltage VSS. The second data writing transistor T21 is a P-type TFT, and the second driving transistor T22 is an N-type TFT.

The pixel unit in the second row and the first column includes a third data writing module, a third driving module and a third organic light-emitting diode OLED3. The third data writing module includes a third data writing transistor T31, a gate electrode of which is connected to the second gate scanning line Gate2, a first electrode of which is connected to the data line Data, and a second electrode of which is connected to the third driving module. The third data writing transistor T31 is configured to apply the data voltage across the data line Data to the third driving module under the control of a second gate scanning signal from the second gate scanning line Gate2. The third driving module includes a third driving transistor T32, a gate electrode of which is connected to the second electrode of the third data writing transistor T31, a first electrode of which is configured to receive the high voltage VDD, and a second electrode of which is connected to an anode of the third organic light-emitting diode OLED3. The third driving transistor T32 is configured to drive the third organic light-emitting diode OLED3 to emit light in accordance with the data voltage across the data line Data. A cathode of the third organic light-emitting diode OLED3 is configured to receive the low voltage VSS. The third data writing transistor T31 is an N-type TFT, and the third driving transistor T32 is an N-type TFT too.

The pixel unit in the second row and the second column includes a fourth data writing module, a fourth driving module and a fourth organic light-emitting diode OLED4. The fourth data writing module includes a fourth data writing transistor T41, a gate electrode of which is connected to the second gate scanning line Gate2, a first electrode of which is connected to the data line Data, and a second electrode of which is connected to the fourth driving module. The fourth data writing transistor T41 is configured to apply the data voltage across the data line Data to the fourth driving module under the control of the second gate scanning signal from the second gate scanning line Gate2. The fourth driving module includes a fourth driving transistor T42, a gate electrode of which is connected to the second electrode of the fourth data writing transistor T41, a first electrode of which is configured to receive the high voltage VDD, and a second electrode of which is connected to an anode of the fourth organic light-emitting diode OLED4. The fourth driving transistor T42 is configured to drive the fourth organic light-emitting diode OLED4 to emit light in accordance with the data voltage across the data line Data. A cathode of the fourth organic light-emitting diode OLED4 is configured to receive a low voltage VSS. The fourth data writing transistor T41 is a P-type TFT, and the fourth driving transistor T42 is an N-type TFT.

The pixel unit in the third row and the first column includes a fifth data writing module, a fifth driving module and a fifth organic light-emitting diode OLED5. The fifth data writing module includes a fifth data writing transistor T51, a gate electrode of which is connected to the third gate scanning line Gate3, a first electrode of which is connected to the data line Data, and a second electrode of which is connected to the fifth driving module. The fifth data writing transistor T51 is configured to apply the data voltage across the data line Data to the fifth driving module under the control of a third gate scanning signal from the third gate scanning line Gate3. The fifth driving module includes a fifth driving transistor T52, a gate electrode of which is connected to the second electrode of the fifth data writing transistor T51, a first electrode of which is configured to receive the high voltage VDD, and a second electrode of which is connected to an anode of the fifth organic light-emitting diode OLED5. The fifth driving transistor T52 is configured to drive the fifth organic light-emitting diode OLED5 to emit light in accordance with the data voltage across the data line Data. A cathode of the fifth organic light-emitting diode OLED5 is configured to receive the low voltage VSS. The fifth data writing transistor T51 is an N-type TFT, and the fifth driving transistor T52 is an N-type TFT too.

The pixel unit in the third row and the second column includes a sixth data writing module, a sixth driving module and a sixth organic light-emitting diode OLED6. The sixth data writing module includes a sixth data writing transistor T61, a gate electrode of which is connected to the third gate scanning line Gate3, a first electrode of which is connected to the data line Data, and a second electrode of which is connected to the sixth driving module. The sixth data writing transistor T61 is configured to apply the data voltage across the data line Data to the sixth driving module under the control of the third gate scanning signal from the third gate scanning line Gate3. The sixth driving module includes a sixth driving transistor T62, a gate electrode of which is connected to the second electrode of the sixth data writing transistor T61, a first electrode of which is configured to receive the high voltage VDD, and a second electrode of which is connected to an anode of the sixth organic light-emitting diode OLED6. The sixth driving transistor T61 is configured to drive the sixth organic light-emitting diode OLED6 to emit light in accordance with the data voltage across the data line Data. A cathode of the sixth organic light-emitting diode OLED6 is configured to receive the low voltage VSS. The sixth data writing transistor T61 is a P-type TFT, and the sixth driving transistor T62 is an N-type TFT.

Figure 3:
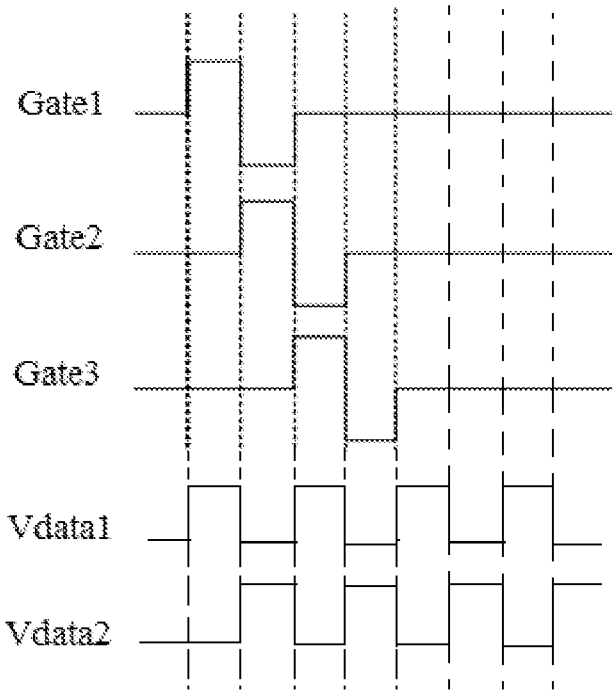
FIG. 3 is a sequence diagram of signals for driving the display panel according to one embodiment of the present disclosure.

FIG. 3 is a sequence diagram of the first gate scanning signal from the first gate scanning line Gate1, the second gate scanning signal from the second gate scanning line Gate2, the third gate scanning signal from the third gate scanning line Gate3, a first data voltage Vdata1 and a second data voltage Vdata2 for driving the display panel in FIG. 2.

As shown in FIG. 3, the first gate scanning line Gate1, the second gate scanning line Gate2 and the third gate scanning line Gate3 are scanned progressively. A positive pulse signal and a negative pulse signal are outputted from the first gate scanning line Gate1 sequentially, so as to turn on the first data writing transistor T11 and the second data writing transistor T21 sequentially, thereby to apply the first data voltage Vdata1 to the first data writing transistor T11 and apply the second data voltage Vdata2 to the second data writing transistor T21. A positive pulse signal and a negative pulse signal are outputted from the second gate scanning line Gate2 sequentially, so as to turn on the third data writing transistor T31 and the fourth writing data transistor T41 sequentially, thereby to apply the first data voltage Vdata1 to the third data writing transistor T31 and apply the second data voltage Vdata2 to the fourth data writing transistor T41. A positive pulse signal and a negative pulse signal are outputted from the third gate scanning line Gate3 sequentially, so as to turn on the fifth data writing transistor T51 and the sixth data writing transistor T61 sequentially, thereby to apply the first data voltage Vdata1 to the fifth data writing transistor T51 and apply the second data voltage Vdata2 to the sixth data writing transistor T61.

In FIG. 2, all of transistors T11, T21, T32 and T42 are switch transistors for applying the data voltage across the data line to the corresponding driving modules, and both transistors T12 and T22 are driving transistors, wherein luminance of the corresponding OLEDs may be controlled by controlling the current flowing through the driving transistors in accordance with the data voltage across the data line.

During the implementation, each pixel unit may further include a storage capacitor connected between the gate electrode and the first electrode of the driving transistor of the pixel unit.

During the implementation, the first gate scanning line Gate1, the second gate scanning line Gate2 and the third gate scanning line Gate3 may each output the first pulse signal and the negative pulse signal at a certain interval.

In the embodiments of the present disclosure, the positive and negative pulse signals may be outputted from the gate scanning line alternately, so as to turn on and off the N-type TFTs and the P-type TFTs connected to an identical data line. As a result, it is able to reduce the number of the data lines without increasing the number of the gate scanning lines, and drive the corresponding pixel units in accordance with the data signals written in a time-division manner.

The present disclosure further provides in some embodiments a method for controlling the above-mentioned display panel, which includes a step of: applying the data voltage across the data line to the data writing modules of the N adjacent pixel units in the time-division manner under the control of the current-level gate scanning signal, wherein the N adjacent pixel units are in the identical row and connected to the data line, and N is an integer greater than 1.

The present disclosure further provides in some embodiments a method for controlling the above-mentioned display panel, which includes a step of, at the data writing stage within each display period, turning on, in a time-division manner, the first data writing transistor of the first pixel unit and the second data writing transistor of the second pixel unit adjacent to the first pixel unit in an identical row, so as to apply, in a time-division manner, the data voltage across the data line to the first pixel unit and the second pixel unit connected to the data line.

The present disclosure further provides in some embodiments a display device including the above-mentioned display panel. The display device may be any product or member having a display function, such as an electronic paper, an OLED display device, a mobile phone, a flat-panel computer, a television, a display, a laptop computer, a digital photo frame or a navigator.

The above are merely the optional embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display panel, comprising a plurality of pixel units, a plurality of gate scanning lines arranged on a display substrate, and a plurality of data lines arranged on the display substrate and crossing the gate scanning lines, wherein each of the pixel units comprises a data writing circuit, a driving circuit and a light-emitting element;

the data writing circuit is configured to apply a data voltage to the driving circuit under the control of a current-level gate scanning signal, and the driving circuit is configured to drive the light-emitting element to emit light in accordance with the data voltage;

the data writing circuits of N adjacent pixel units in an identical row are connected to an identical data line, and N is an integer greater than 1; and the data voltage across the data line is applied to the data writing circuits of the N adjacent pixel units in a time-division manner under the control of the current-level gate scanning signal;

the N adjacent pixel units in the identical row comprise a first pixel unit and a second pixel unit;

the first pixel unit includes a first data writing circuit, a first driving circuit, and a first light-emitting element, the first data writing circuit includes a first transistor, the first driving circuit includes a first driving transistor, wherein a gate electrode of the first transistor is configured to receive the current-level gate scanning signal, a first electrode of the first transistor is connected to one of the data lines, a second electrode of the first transistor is connected directly to the first driving transistor, the first driving transistor is connected directly to the first light-emitting element, and the first transistor is not connected directly to the first light-emitting element;

the second pixel unit includes a second data writing circuit, a second driving circuit, and a second light-emitting element, the second data writing circuit includes a second transistor, the second driving circuit includes a second driving transistor, wherein a gate electrode of the second transistor is configured to receive the current-level gate scanning signal, a first electrode of the second transistor is connected to the one of the data lines, a second electrode of the second transistor is connected directly to the second driving transistor, the second driving transistor is connected directly to the second light-emitting element, and the second transistor is not connected directly to the second light-emitting element; and the second pixel unit and the second pixel unit are located in an identical row.

2. The display panel according to claim 1, wherein N is 2; and at a stage within each display period, the first transistor and the second transistor are turned on in the time-division manner under the control of the current-level gate scanning signal.

3. The display panel according to claim 2, wherein the first transistor is an N-type transistor, and the second transistor is a P-type transistor.

4. The display panel according to claim 3, wherein the light-emitting element comprises an OLED.

5. The display panel according to claim 2, wherein the first transistor is a P-type transistor, and the second transistor is an N-type transistor.

6. The display panel according to claim 2, wherein a data writing circuit of a pixel unit in an $m^{th}$ row and a $(2n+1)^{th}$ column and a data writing circuit of a pixel unit in the $m^{th}$ row and a $(2n+2)^{th}$ column are connected to an $n^{th}$ data line and configured to receive a data voltage across the $n^{th}$ data line in the time-division manner, m is a positive integer within a range from 1 to A, n is a positive integer within a range from 1 to B, A and B are both positive integers, A is equal to the number of the plurality of gate scanning lines, and 2B+2 is equal to the number of the plurality of data lines.

7. The display panel according to claim 2, wherein the light-emitting element comprises an OLED.

8. A method for controlling the display panel according to claim 2, comprising a step of: at the data writing stage within each display period, turning on the first transistor and the second transistor in the time-division manner, so as to apply the data voltage across the data line to the first pixel unit and the second pixel unit in the time-division manner.

9. The display panel according to claim 1, wherein the light-emitting element comprises an organic light-emitting diode (OLED).

10. The display panel according to claim 1, wherein each of the pixel units further comprises a storage capacitor, the driving circuit of the pixel unit includes a driving transistor, and the storage capacitor is connected between a gate electrode and a first electrode of the driving transistor.

11. A method for controlling the display panel according to claim 1, comprising a step of: applying the data voltage across the data line to the data writing circuits of the N adjacent pixel units in the time-division manner under the control of the current-level gate scanning signal, wherein the N adjacent pixel units are in the identical row and connected to the data line, and N is an integer greater than 1.

12. A display device comprising the display panel according to claim 1.

13. The display device according to claim 12, wherein N is 2; and at a stage within each display period, the first transistor and the second transistor are turned on in the time-division manner under the control of the current-level gate scanning signal.

14. The display device according to claim 13, wherein the first transistor is an N-type transistor, and the second transistor is a P-type transistor.

15. The display device according to claim 14, wherein the light-emitting element comprises an OLED.

16. The display device according to claim 13, wherein the first transistor is a P-type transistor, and the second transistor is an N-type transistor.

17. The display device according to claim 13, wherein a data writing circuit of a pixel unit in an $m^{th}$ row and a $(2n+1)^{th}$ column and a data writing circuit of a pixel unit in an $m^{th}$ row and a $(2n+2)^{th}$ column are connected to an $n^{th}$ data line and configured to receive a data voltage across the $n^{th}$ data line in the time-division manner, m is a positive integer within a range from 1 to A, n is a positive integer within a range from 1 to B, A and B are both positive integers, A is equal to the number of the plurality of gate scanning lines, and 2B+2 is equal to the number of the plurality of data lines.

18. The display device according to claim 13, wherein the light-emitting element comprises an OLED.

19. The display device according to claim 12, wherein the light-emitting element comprises an OLED.

20. The display device according to claim 12, wherein each of the pixel units further comprises a storage capacitor, the driving circuit of the pixel unit includes a driving transistor, and the storage capacitor is connected between a gate electrode and a first electrode of the driving transistor.

* * * * *